US008014554B2

(12) United States Patent
Xu et al.

(10) Patent No.: US 8,014,554 B2
(45) Date of Patent: Sep. 6, 2011

(54) AUTOMATIC TILT SPEAKER

(76) Inventors: Ming Xu, Nanjing (CN); Qing Ren Meng, Huntington Beach, CA (US)

( * ) Notice: Subject to any disclaimer, the term of this patent is extended or adjusted under 35 U.S.C. 154(b) by 1231 days.

(21) Appl. No.: 11/709,454

(22) Filed: Feb. 21, 2007

(65) Prior Publication Data

US 2008/0199037 A1 Aug. 21, 2008

(51) Int. Cl.
*H04R 1/00* (2006.01)

(52) U.S. Cl. ..... 381/386; 381/387; 381/395

(58) Field of Classification Search ..... 381/87, 381/332, 334, 336, 152, 182, 186, 386–388, 381/395; 181/141, 150, 199; 248/343
See application file for complete search history.

(56) References Cited

U.S. PATENT DOCUMENTS

2006/0084468 A1* 4/2006 Kim ..... 455/550.1
2007/0253304 A1* 11/2007 Hsu ..... 369/65
* cited by examiner

*Primary Examiner* — Tuan Nguyen
(74) *Attorney, Agent, or Firm* — Clement Cheng

(57) ABSTRACT

An automatic tilt speaker has a first subassembly of a speaker unit enclosing an ordinary speaker element. The speaker unit includes a cone-shaped housing having an inner cavity for holding the speaker with its frame or basket fitted snugly in an annular frame. The housing of the speaker unit is pivotally connected to the frame by a pivot arm. The speaker housing has an arcuate exterior wall extending in a radius centered about the pivot connection of the frame. Centrally of the arcuate wall, there is a gear arch, which comprises a vertical column of horizontally elongated teeth extending substantially coplanar with the arcuate wall. On the annular frame at the diametrically opposite side of the pivot connection a tilting system is operatively connected with the teeth. The tilting system includes a motor with a reduction gearbox for driving a worm gear, which in turn drives the gear arch. The annular frame also supports a relay-based motor control board for controlling the polarity and power to the motor. Combined with the power control is a position sensing system including three slight ramp surfaces on the arcuate wall of the speaker unit which translates into three segmented tilting angles to be remotely selected to the user's listening preference.

22 Claims, 7 Drawing Sheets

AUTOMATIC TILT SPEAKER

BACKGROUND OF THE INVENTION

A. Field of the Invention

The present invention relates to an audio speaker. More particularly, the present invention relates to an automatic tilting mechanism for speakers normally mounted flush with room walls or ceiling.

B. Description of the Prior Art

A loudspeaker or speaker is an electromagnetic transducer for converting an electrical signal produced by an audio record player into sound of such as music that listeners can appreciate. The speaker components have been engineered to reproduce the source sounds with higher fidelity but less distortion. Among the ubiquitous speakers that are present wherever speeches and/or sounds of music are desired, wall and ceiling speakers are the special kind of audio components built into the building structure for who wishes the space to be an entertainment area when and where music or movie audio is played in a theatrical scale as the currently popular home theater systems demonstrate. As any audio fans as well as the professional speaker installers have experienced, finding a desired combination of speakers with different audio characters like frequency ranges may be just the start of a more difficult task of placing them in the architecture.

U.S. Pat. No. 6,101,262 to Haase, et al. is directed to a panel mount speaker system wherein the speaker unit is framed in a primary spherical mount and a smaller spherical mount member having a common pivot point so that the inner speaker assembly may swivel in certain angular range bearing against the opposing spherical surfaces of outer housing members. Because the speaker unit is made invisibly directional behind the flush profile of the system the desirable radiation of sound is blocked by the interior edges of the housing front face, which is again regulated by the architectural specification for speakers.

This means more speakers per unit area when a flexible sound system might need only a limited number of speakers to fulfill the audio need of the listener within the confinement of a residential space. In addition, the '262 speaker rotates along a three dimensional sphere like a ball joint rather than a linear track set to follow suit and thus it is not made adaptable to motorization that can be remotely controlled unless it equips a complex x-y-z axes mechanism to make the spherical motion. When the audio listener wants a better directional control of selected speakers such as after moving the seating position, lack of an automatic control system will lead to professional high ceiling job involving time consuming trials to adjust the ceiling speakers to the listener's preferences.

Therefore, there is an obvious need for an advanced speaker support mechanism to provide an in-wall and in-ceiling mounting with a simple automatic adjustment of the direction of sound propagation without having to manually rotate the speakers.

As for motorization, U.S. Pat. No. 5,321,760 to Gray suggested making a speaker retractable into an automobile interior wall. In this patent a retractable speaker assembly makes complex movements on a platform following an up-down swivel path formed on a first stationary frame member and then in a left-right rotation about the speaker's own pivot shaft as two independent actuators power the respective directional movements. In addition, to maintain the balance of the speaker body in motion, the rotation mechanism has at the opposite side of the speaker assembly a second frame member that is similarly toothed as the first frame member to effect parallel geared rotations in and out of the surface with which the speaker assembly becomes flush when retracted.

Doubled rotational parts may call for increased mechanical failures resulting in earlier periodic maintenances of the automobile, which is a relatively handy product to handle. But for speakers in architectural placements mechanizing them to perform the similar retraction and extension should be realized in a highly durable way to meet the high expectations set in the field of the architectural speakers. Once installed, such speakers are frequently guaranteed to work with minimum maintenance during the lifetime of the building.

In view of the foregoing shortcomings and unmet needs, the object of the present invention is to provide an automatic tilt speaker for in-wall and in-ceiling installation with a reliable simplicity in construction.

Another object of the present invention is to provide an automatic tilt speaker easy to the ultimate user as well as the installing and maintenance personnel.

Yet another object of the present invention is to provide a reliable pedestal speaker that is visually unobtrusive at rest and positively delivers more direct sounds in operation thereby promoting adaptation of the room atmosphere wisely for both the rest and recreations.

SUMMARY OF THE INVENTION

The automatic tilt speaker of the present invention has a first subassembly of a speaker unit enclosing an ordinary speaker element, which may be a dynamic cone loudspeaker formed to work as a woofer, midrange, tweeter or other units. The speaker unit includes a cone-shaped housing having an inner cavity for holding the speaker with its frame or basket fitted snugly around an annular seat facing inwardly at the open end of the housing. Mounted to the rear of the annular seat of the speaker housing is an annular frame, which is formed by two large ring plates stepped by a vertical connecting wall to cover the external walls of the annular seat loosely. To the frame the housing of the speaker unit is pivotally connected by a pivot arm formed integral to a lower side of the vertical connecting wall.

The speaker housing has an arcuate exterior wall extending from the annular seat all the way to the apex of the housing in a radius centered about the pivot pin of the frame. Centrally of the arcuate wall, there is a gear arch, which comprises a vertical column of horizontally elongated teeth extending substantially coplanar with the arcuate wall.

On the annular frame at the diametrically opposite side of the pivot connection a tilting system is operatively connected with the teeth. The tilting system includes a motor with a reduction gearbox. Connected to the gearbox is a worm gear in mesh with the gear arch. The motor with gearbox and the worm gear are supported on the frame by a U-shaped bracket, which holds the driving worm gear so that it protrudes to engage the driven gear arch tangentially thereto. The worm gear resembles rack and pinion in that the driving worm gear with parallel helical teeth mates with the sector gear or gear arch and its rotational torque is converted to a near linear force that drives the housing along the large radius of the arcuate track of the wall.

The annular frame also supports a relay-based motor control board for controlling the polarity and power to the motor. Combined with the power control is a position sensing system including three slight ramp surfaces on the arcuate wall of the speaker unit. Each of the ramps has an isolated vertical track for a paired limit switch to control the motor in response to the changing degrees of tilt of the speaker unit. The limit switch has a small wheeled cantilever running on certain topography of a moving part.

At opposing lateral sides of the bracket there are provided three limit switches to work with the ramps. The limit switches make or break a motor driving circuit in response to an ascending or descending movement of the speaker unit. By sending a wired or wireless remote control signal a user may direct the tilting degree of the speaker unit.

An outer shell fully covers the rear side of the speaker unit-annular frame assembly to protect the electric and mechanical moving parts of the speaker. In addition, the outer shell holds a cluster of electrical plugs for audio terminals, positive and negative power terminals and user control signal connections.

The motor control board receives the signal from the ramp switches at switch input while the user control signal is input. Then, the motor control board processes the individual ramp switch input and user control and synthesizes the motor signal, which drives the motor in order to tilt the speaker of the present invention at the preferred angle that best suits the acoustic environment. When not in the mood for speaker sound or its appearance, the user may remotely signal the speaker to hide flat on the surrounding surface be it a room wall or ceiling.

Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
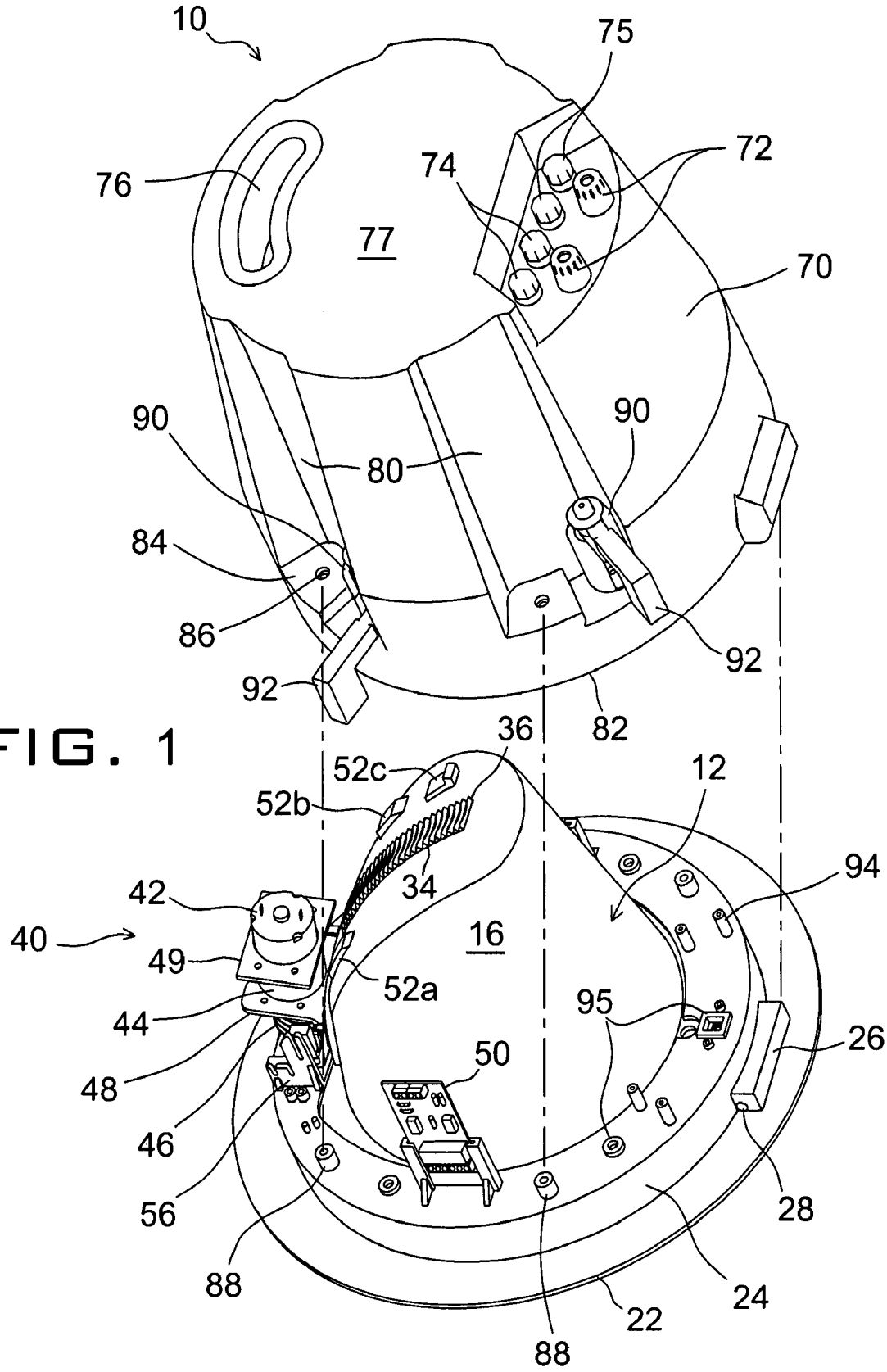
FIG. 1 is an exploded perspective view of an automatic tilt speaker according to the present invention.
Figure 2A:
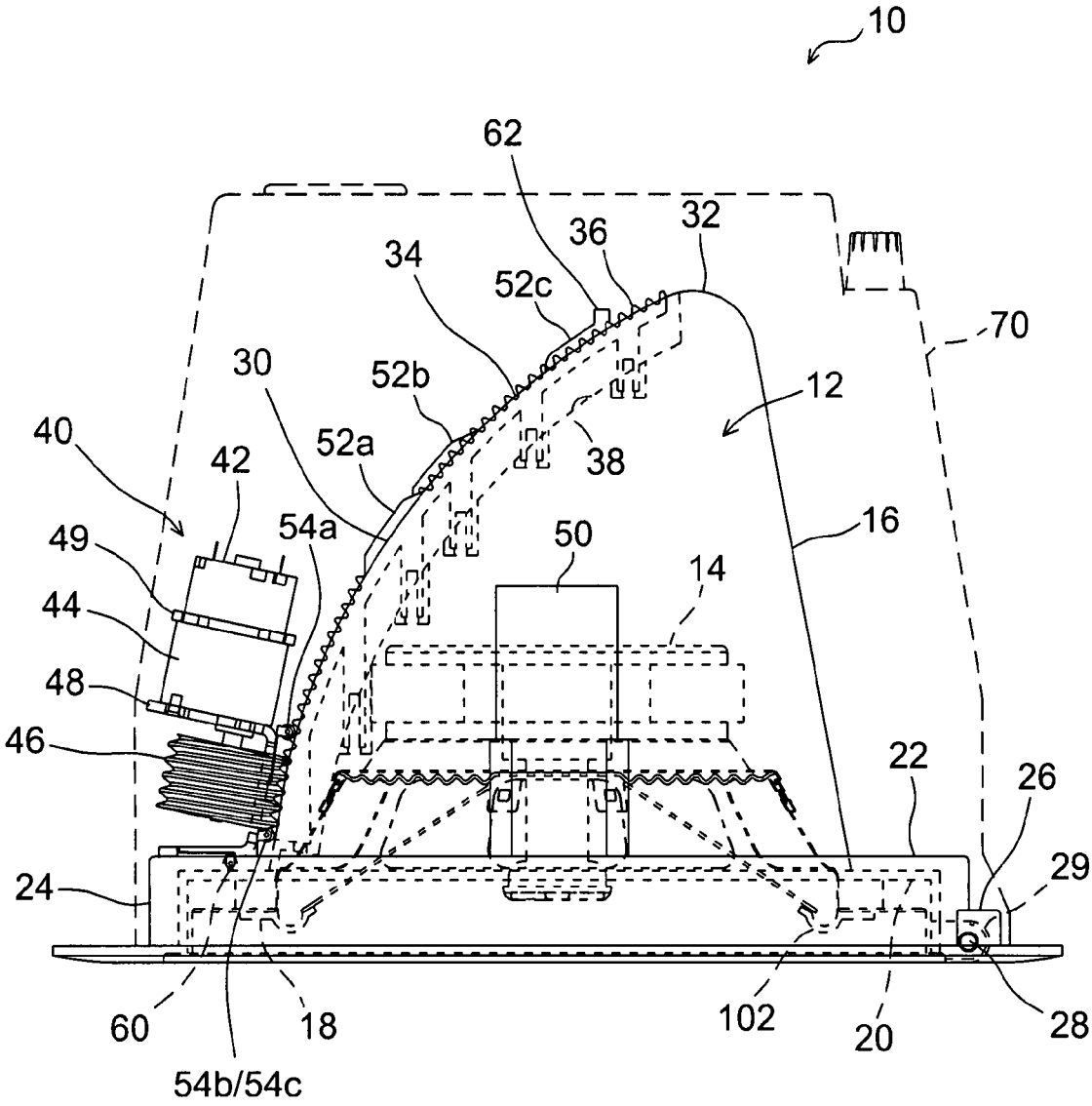
FIG. 2A is a side elevational view of the speaker of FIG. 1 in its retracted position at rest.

With reference to FIGS. 1 and 2A, an automatic tilt speaker 10 of the present invention has a first subassembly of a speaker unit 12 enclosing an ordinary speaker element 14, which may be a dynamic cone loudspeaker formed to work as a woofer, midrange, tweeter or other units. Typical speaker includes vibrating components of a lightweight semi-rigid cone or diaphragm and a coil of fine copper wire at the apex of the cone, suspension components of a spider near the apex coil and a rubber surround affixed at the outer circumference of the cone, a relatively heavy permanent magnet that surrounds the coil, and a rigid support structure of round plates and a cone frame for supporting the magnet and the vibrating components dynamically via the suspension components.

The speaker unit 12 includes a cone-shaped housing 16 having an inner cavity for holding the speaker 14 with its frame or basket 18 fitted snugly around an annular seat 20 facing inwardly at the open end of the housing 16. The housing 16 may be made from selected one or combinations of polypropylene (PP), aluminum, injection molded graphite PP, and glass fiber used to commonly for making the speakers.

Screws may be used to fasten the speaker 14 to the housing as is customary in the trade of speaker installation. To absorb interfering sound energy created in the back of the speaker, the remaining space in the housing 16 over the speaker 14 may be filled with a dampening material such as fiberglass, wool or synthetic fiber batting.

Mounted to the rear of the annular seat 20 of the housing 16 is an annular frame 22, which is formed by two large ring plates stepped by a vertical connecting wall 24 to cover the external walls of the annular seat 20 loosely. The frame 22 has a hinge box 26 integrally formed to support a pivot pin 28 to which the housing 16 of the speaker unit 12 is pivotally connected. For this purpose, the speaker unit 12 also has a pivot arm 29 formed integral to a lower side of the vertical connecting wall 24 with a transverse hole for the pivot pin 28.

The speaker housing 16 has an arcuate exterior wall 30 extending from the annular seat 20 all the way to the apex 32 of the housing 16 in a radius centered about the pivot pin 28 of the frame 22. The arcuate wall 30 spans a substantially constant width throughout its length. Centrally of the wall 20, there is a gear arch 34, which comprises a vertical column of horizontally elongated teeth 36 extending substantially coplanar with the arcuate wall 30. The gear arch 34 may be formed integral to the arcuate wall 30 of the speaker unit 12. Or it may be made into a separate member attached to an elongated arcuate recess 38 as shown in FIG. 2A.

Figure 3A:
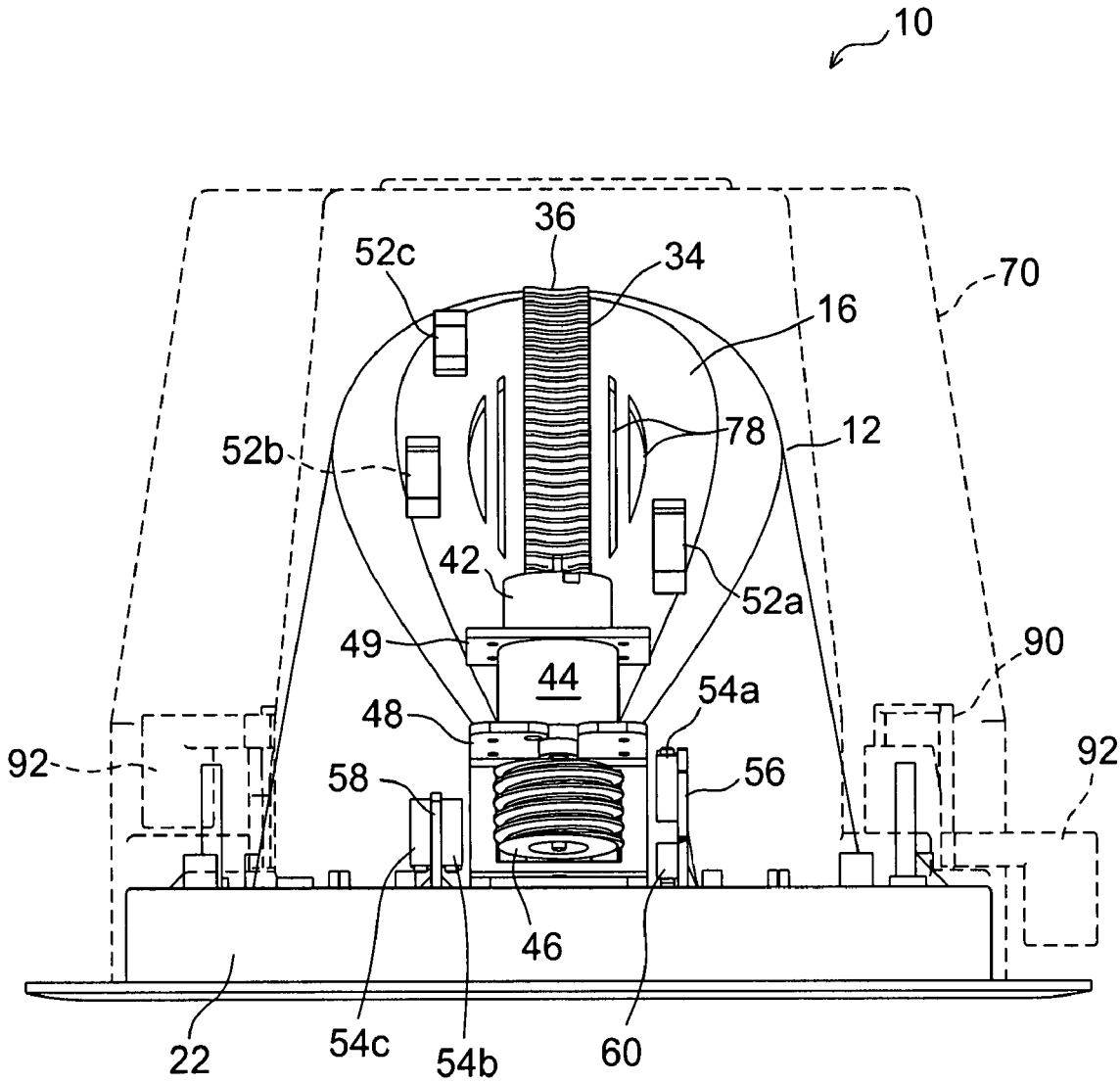
FIG. 3A is a front view of the speaker of FIG. 2A showing the elements of the tilting mechanism more clearly.

On the annular frame 22 at the diametrically opposite side of the pivot pin 28 a tilting unit 40 is operatively connected with the teeth 36. The tilting unit 40 includes a motor 42 with a reduction gear box 44 surrounding the output side of the motor 42. Connected to the gear box 44 is a worm gear 46 in mesh with the gear arch 34. The motor 42 with gear box 44 and the worm gear 46 are supported on the frame 22 by a U-shaped bracket 48, which holds the driving worm gear 46 so that it protrudes to engage the driven gear arch 34 tangentially thereto. See FIGS. 2A and 3A. The assembly of motor 42 and gear box 44 may be fitted with a horizontal flange 49 for securing their positions relative to the bracket 48 by two or more long screws not shown. The bracket 48 may be made of a piece of metal stamped and bent to clinch the motor-worm gear assembly keeping them exposed for easy maintenance and direct transmission of the rotational torque.

Figure 2B:
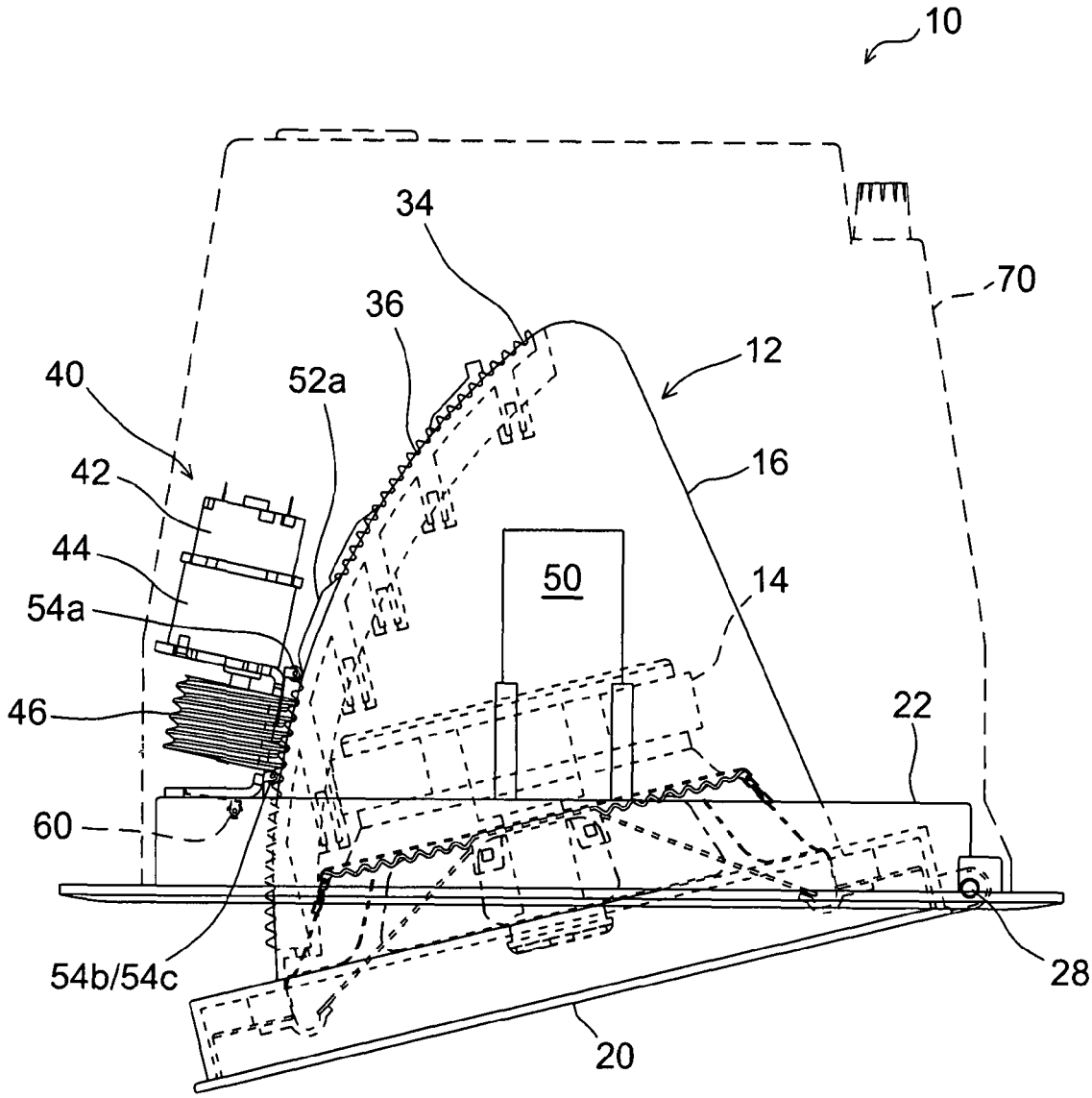
FIG. 2B is a side elevational view of the speaker of FIG. 1 in one of its tilted position in operation.

The worm gear 46 resembles rack and pinion in that the driving worm gear with parallel helical teeth mates with the sector gear or gear arch 34 and its rotational torque is converted to a near linear force that drives the housing 16 along the large radius of the arcuate track of the wall 30 as shown in FIG. 2B.

The annular frame 22 also supports a relay-based motor control board 50 for controlling the polarity and power to the motor 42. Relay-based motor controls are well known devices in the art and does not constitute a critical part of the invention. Combined with the power control 50 is a position sensing system including three slight ramp surfaces on the arcuate wall 30 of the speaker unit 12 of which a lowermost ramp 52*a* is located at one side of the gear arch 34 at a low level with respect to the annular seat 20 of the housing 16, a middle ramp 52*b* and top ramp 52*c* are located at the opposite side of the gear arch 34 at about midlevel and next to the top group of teeth 36 of the gear arch 34, respectively. Each of the ramps 52*b* and 52*c* has an isolated vertical track for a paired limit switch to control the motor 42 in response to the changing degrees of tilt of the speaker unit 12.

At opposing lateral sides of the bracket 48 there are provided three limit switches 54*a*-54*c* to work with the ramps 52*a*-52*c*. These ramp switches may be fastened to slotted posts 56 and 58 formed integral to the frame 22, as clearly shown in FIG. 3A. The limit switches may be one of the known type having encased electrical contacts that make or break an electric circuit in response to an ascending or descending movement of a small wheeled cantilever running on certain topography of a moving part.

Here, the speaker unit 12 lying flush with the annular frame 22 at rest has a bottom switch 60 activated as it is pushed against the opposite surface of the annular frame 22 from the annular seat 20 to maintain the motor 42 deenergized until a user control signal is applied.

The lowermost ramp 52*a* is adapted to sense the action of a first ramp switch 54*a* initially upon a first preset tilting advance of the speaker unit 12 from 0 to 15 degrees about the pivot pin 28. By sending a wired or wireless remote control signal a user may direct the tilting degree of the speaker unit 12. In response, when the speaker unit 12 swivels to the 15-degree point the switch 54*a* reaches the top plane surface of the lowermost ramp 52*a* whereby the electric power to the motor 42 is cut off temporarily to halt the speaker unit 12 in that position.

Because the number of gear teeth 36 is determined as for example thirty-six counts the tilting unit 40 and the relay-based motor control board 50 that constitute an analog position control circuit may be modified into a digital equivalent by optically sensing the peaks and valleys of the gear teeth to provide a precise signal of the amount of revolution of the worm gear 46 for use in a continuous speaker tilting angle adjustment rather than preset values within range.

Either subsequently or singularly, a second tilt control signal may be generated by the user to restart the motor 42 to further advance the speaker unit 12 through a set swivel angle such as 30 degrees at which time a second ramp switch 54*b* at the opposite side of the first switch 54*a* across the worm gear 46 takes turn to halt the motor 42 and thus the speaker unit 12. The segmented tilting angles and distances may be determined by the contour and location of the switch ramps 52*a* to 52*c* and fine tuned by adjusting the precise positions of the ramp switches 54*a*-54*c* in the slotted posts 56 and 58 relative to the corresponding ramps 52*a*-52*c*.

In this embodiment, the tilting limit is set as 45 degrees as the gear arch 34 extends a quarter of a full 360-degree circle about the pivot pin 28. This much of tilting is deemed appropriate considering the broad radiation of output sounds right from the same position as the ceiling or walls when the speaker 10 is installed.

The upper tilting end of the speaker unit 12 is sensed by a ramp switch 54*c*, which will ride over the highest ramp 52*c*. The ramp 52*c* has an upturned tip 62 to help stop a further swivel of the speaker unit 12. Return trip of the speaker unit 12 upward toward the initial flush position is the exact opposite to the down tilting steps with a reverse rotational signal to the motor 42.

Figure 3B:
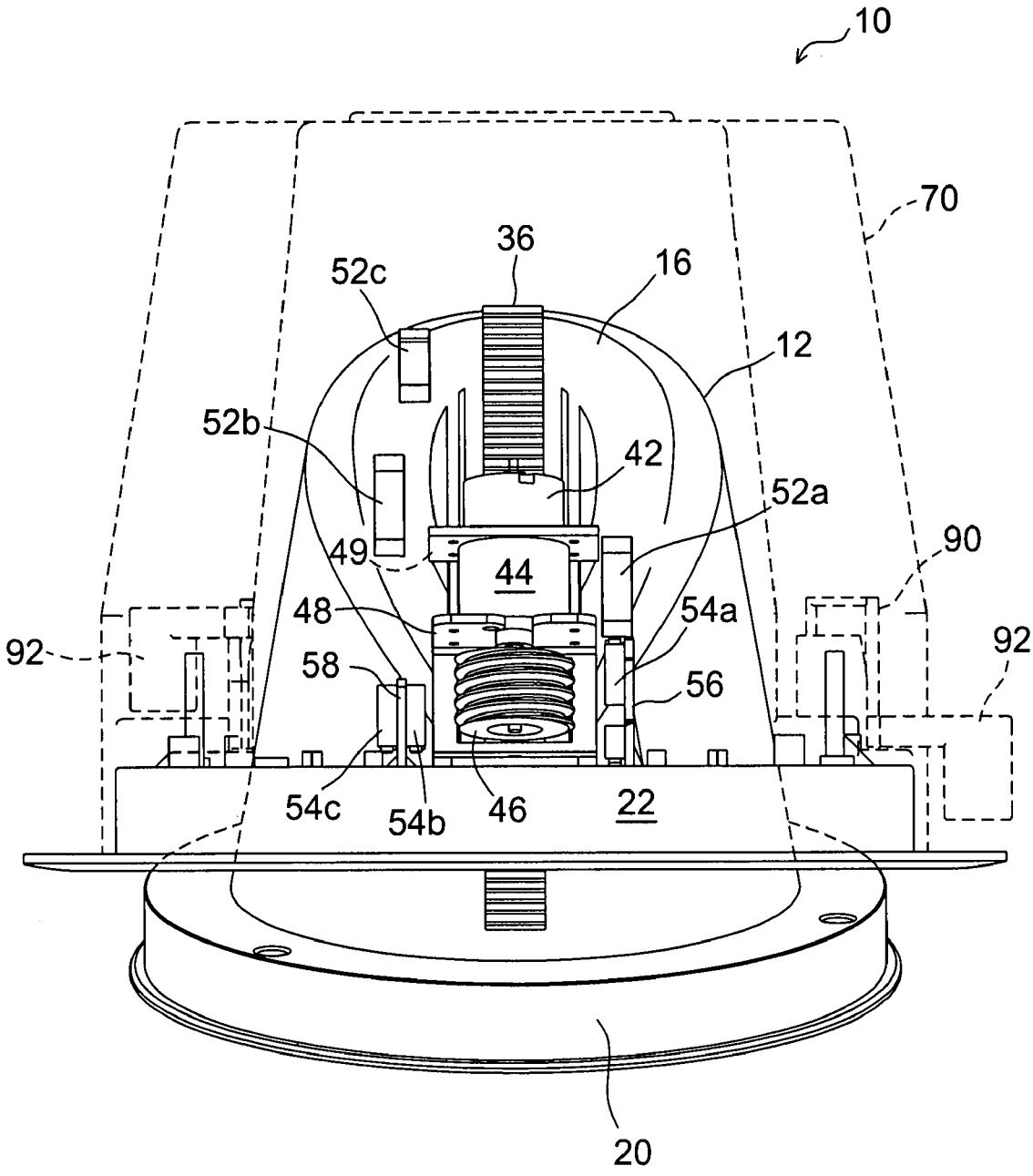
FIG. 3B is a front view of the speaker of FIG. 2B shown in the same tilted position from the ceiling toward a listener below and behind the drawing sheet.

With particular reference to FIGS. 1 and 3B, an outer shell 70 fully covers the rear side of the speaker unit-annular frame assembly to protect the electrical and mechanical moving parts of the speaker 10. In addition, the outer shell 70 holds a cluster of electrical plugs for audio terminals 72, positive and negative power terminals 74, and user control signal connections 75. In order to balance the pressure around the vibrating speaker diaphragm, an air hole 76 is formed at the top surface 77 of the shell 70. For the same purpose, the speaker unit 12 has multiple slits 78 through the arcuate wall 30 of housing 16 besides the gear arch 34 and ramps 52*a*-52*c*. The shell 70 also has four vertical recesses 80 extending from the top surface 77 and terminating at an even vertical distance from open end 82, which fits snugly over the connecting wall 24 of the frame 22. The lower ends of the recesses 80 are connected to the surrounding walls via horizontal shoulders 84 for supporting fastener system.

Each shoulder 84 includes a screw hole 86 that is aligned with corresponding screw posts 88 formed on the top surface of the annular frame 22 for a secure bonding between the two subassemblies. Also formed on the shoulder 84 is a vertical sleeve 90 with an externally open side slit in which a locking clamp arm 92 is inserted so that it can be swung in alignment with the side slit and moves toward or away from the upper side of annular frame 22 at its outward edge through an adjustment screw threaded in a hole formed in the shoulder 84 at the center of the sleeve 90. In this way the speaker 10 can be adjustably and firmly clamped to an appropriate opening of a ceiling or wall panel having various thickness.

In order to assist in harnessing the necessary electric wires in connecting the motor 42, control board 50 and terminal connection plugs, there are provided a plurality of upright posts 94 and various through-holes 95 formed together with the frame body 22. The wires may be tied down between the posts 94 through appropriate mechanical fasteners or thermal bonding.

Figure 4:
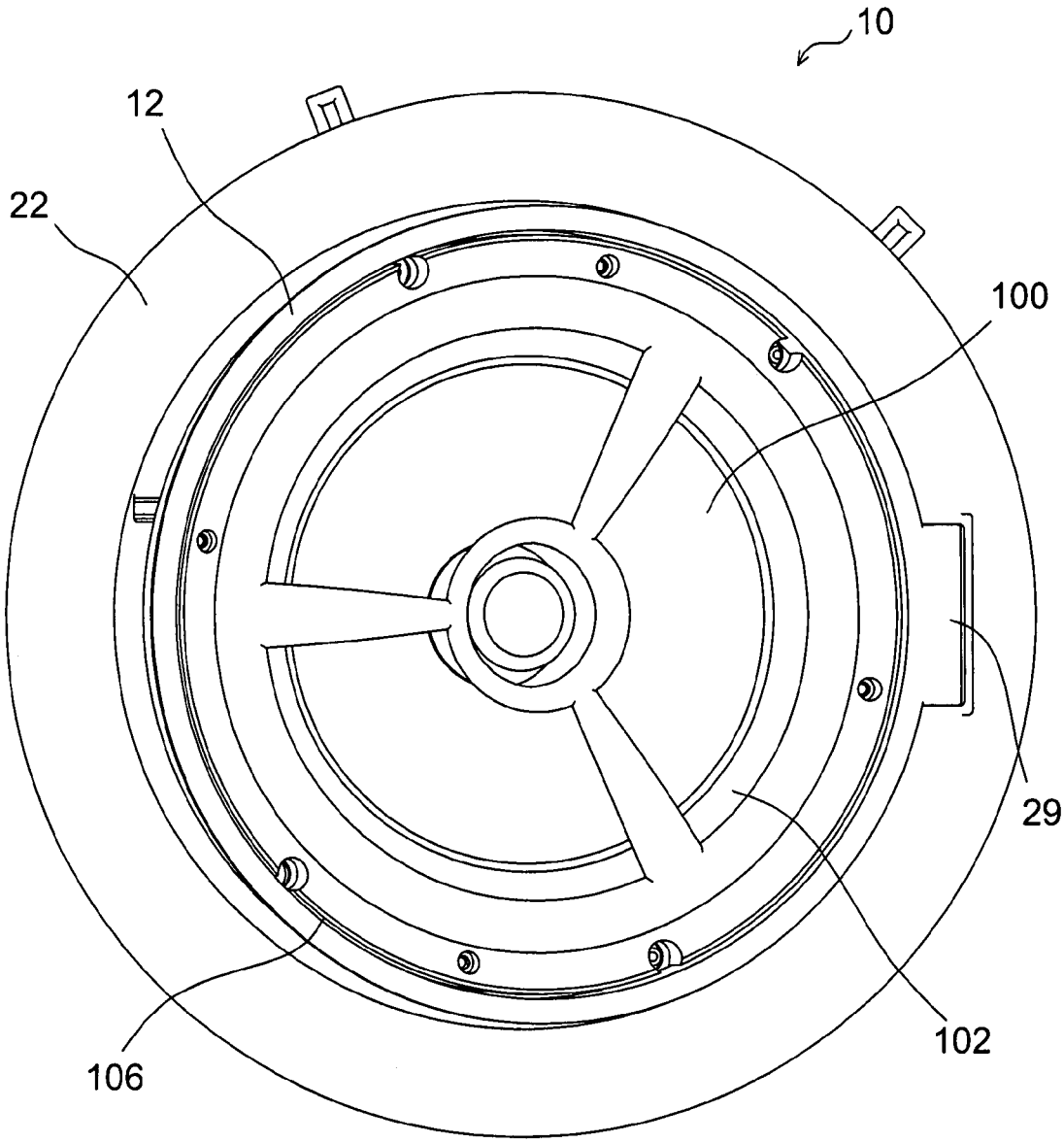
FIG. 4 is a bottom perspective view of the speaker showing the speaker face toward a listener to the right side of the drawing sheet.

FIG. 4 shows the bottom face of the speaker 10 after installation where the speaker unit 12 is slightly tilted against the frame 22 about the hinge arm 29. As briefed above with respect to the typical speaker design, the speaker 10 is shown including vibrating component of a lightweight semi-rigid cone or diaphragm 100, suspension component of a rubber surround 102 affixed at the outer circumference of the cone 100, and grill 104 for protecting the speaker face.

Then, the speaker 10 may be fitted with a perforated screen bezel in a clearance 106 between the speaker unit 12 and grill 104 to block dust and provide an aesthetic value to the speaker 10

Figure 5:
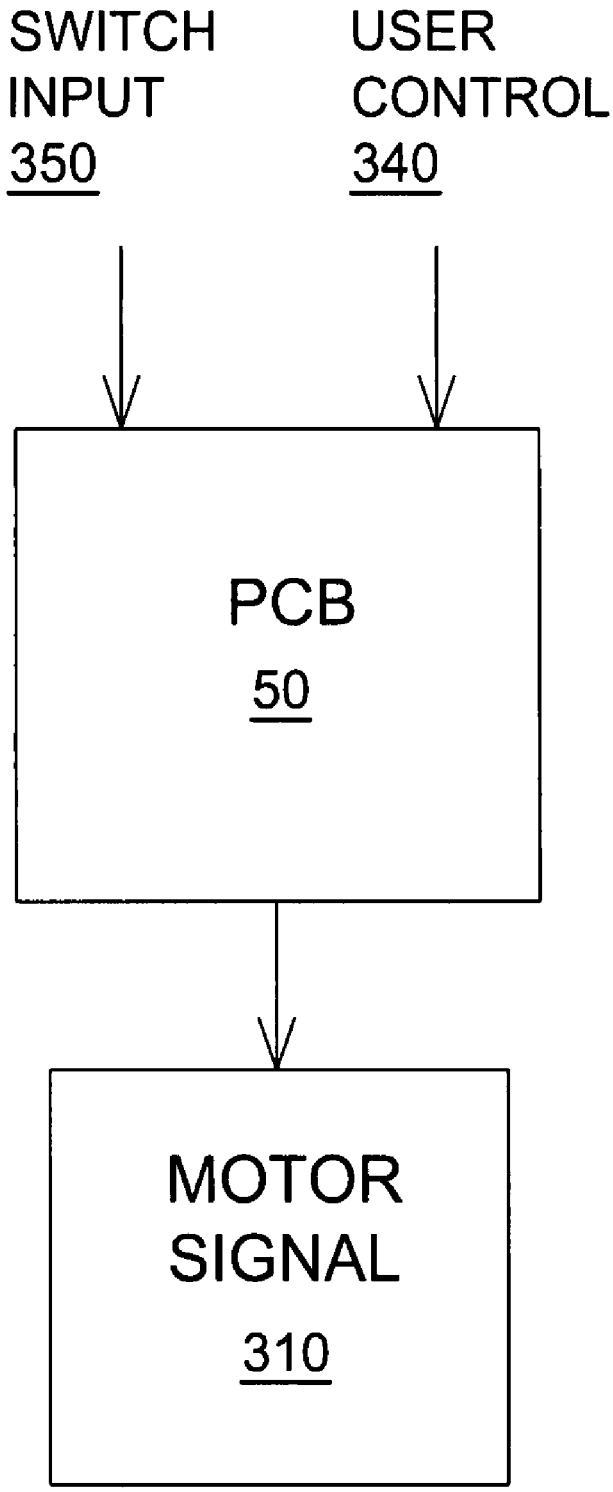
FIG. 5 is a block diagram of the electrical configuration of the present invention.

FIG. 5 shows the electrical diagram of the present invention. The motor control board 50 receives the signal from the ramp switches 54*a*-54*c* at switch input 350 while the user control signal is input at terminal 340. Then, the motor control board 50 processes the individual ramp switch input 350 and user control and synthesizes the motor signal 310, which drives the motor 42.

Therefore, while the presently preferred form of the automatic tilting mechanism of the wall-mount speaker has been shown and described, and several modifications thereof discussed, persons skilled in this art will readily appreciate that various additional changes and modifications may be made without departing from the spirit of the invention, as defined and differentiated by the following claims.

The invention claimed is:

1. An automatic tilt speaker comprising:

a conical speaker element in a dome shaped housing that has an arcuate side surface extending from a bottom to an apex, an annular seat for fixedly supporting the speaker element at a rear and outer circumferential area and a hinge member located at a diametrically opposite side of the bottom of the arcuate side surface for moving the speaker element along an arcuate line that coincides with the arcuate side surface about the hinge member;

an annular frame encircling the speaker housing at the exterior of the annular seat of the speaker housing and having a lateral hinge base for mounting the hinge member of the speaker element to permit the speaker element in the housing to freely swivel toward and away from the frame within a certain range limited by a circumferential top interior wall of the annular frame abutting the exterior of the annular seat of the speaker housing;

a tilting system including a motor mounted through a suspension bracket on a top exterior wall of the annular frame at a location close to the arcuate side surface of the speaker housing, a worm gear in a driving connection through a reduction gear set to the motor and an arcuate driven gear section facing opposite to and in mesh with the driving worm gear and extending longitudinally on the arcuate surface of the speaker housing so that driving the motor and thus the worm gear in one direction gradually tilts the housing along with the speaker element away from the annular frame about the hinge connection while driving the same in the other direction gradually tilts the housing and speaker element toward the annular frame;

a control system for processing a remote user signal to initiate the motor in either direction which causes the speaker element to assume one of predetermined angular positions within certain tilting range of the speaker element; and an outer shell for framing the dome housing with speaker element included, the outer shell having a plurality of clamps for mounting the speaker in flush with a wall or ceiling panel at a prepared opening thereof with both sides of the panel clamped between the annular frame and the clamps, and an electrical terminal interface for energizing the speaker element, tilting system and control system.

2. The automatic tilt speaker of claim 1, wherein the arcuate line of the arcuate side surface of the speaker housing extends a quarter of the full 360-degree radius about the hinge member so that the tilting range of the speaker element in the housing is within approximately 45-degree angle.

3. The automatic tilt speaker of claim 1, wherein the control system for receiving a remote user signal to initiate the motor in either direction further has an automatic stop system for breaking the electric power to the motor, the stop system including a number of ramps formed on the arcuate surface and the annular seat of the speaker housing and a corresponding number of limit switches, one of which being held to interact with annular seat for sensing the movement of the speaker housing to the completely retracted position while the rest being held against the arcuate surface of the speaker housing to interact with the paired ramps using the angular displacement of the speaker housing for breaking the electric power to the motor and thus halts further movements of the speaker housing until another user signal is received by the control system.

4. The automatic tilt speaker of claim 1, wherein the control system for processing a remote user signal to initiate the motor in either direction comprises a digital counter system for counting the number of the gear teeth of the arcuate driven gear section of the speaker housing by optically sensing the peaks and valleys of the gear teeth to provide a precise signal of the amount of revolution of the worm gear for use in a continuous speaker tilting angle adjustment rather than preset values within range.

5. The automatic tilt speaker of claim 1, wherein the arcuate driven gear section of the speaker housing comprises a separate member of a vertical column of horizontally elongated teeth extending substantially coplanar with the arcuate side surface and an elongated arcuate recess formed in the walls of the arcuate side surface of the speaker housing for fixedly receiving the vertical teeth column.

6. The automatic tilt speaker of claim 1, wherein the speaker housing is made from selected one or combinations of polypropylene, aluminum, injection molded graphite polypropylene, and glass fiber.

7. The automatic tilt speaker of claim 1, wherein the speaker element is a dynamic cone loudspeaker formed to work as a midrange speaker.

8. An automatic tilt speaker comprising:

a speaker;

a housing having an arcuate side surface extending from a housing bottom to a housing apex;

a seat for fixedly supporting the speaker;

a hinge for moving the speaker element along an arcuate line that coincides with the arcuate side surface about the hinge member;

an annular frame encircling the housing and having a hinge base for mounting the hinge;

a tilting system including a motor driving a worm gear that tilts the housing;

a control system for processing a remote user signal to initiate the motor in either direction which causes the speaker element to assume a predetermined angular position; and an outer shell for framing the housing.

9. The automatic tilt speaker of claim 8, wherein the speaker is a conical speaker element.

10. The automatic tilt speaker of claim 8, further comprising an annular seat fixedly supporting the speaker at an annular seat outer circumferential area and wherein the hinge member is located at a diametrically opposite side of the bottom of the arcuate side surface for moving the speaker along an arcuate line that coincides with the arcuate side surface about the hinge member.

11. The automatic tilt speaker of claim 8, wherein the annular frame encircles the housing at the exterior of an annular seat of the housing and having a lateral hinge base for mounting the hinge member of the speaker to permit the speaker element in the housing to freely swivel toward and away from the frame within a certain range limited by a circumferential top interior wall of the annular frame abutting the exterior of the annular seat of the speaker housing.

12. The automatic tilt speaker of claim 8, wherein the tilting system further includes a motor mounted through a suspension bracket on a top exterior wall of the annular frame at a location close to the arcuate side surface of the housing, a worm gear in a driving connection through a reduction gear set to the motor and an arcuate driven gear section facing opposite to and in mesh with the driving worm gear and extending longitudinally on the arcuate surface of the housing.

13. The automatic tilt speaker of claim 8, wherein driving the motor and the worm gear in one direction gradually tilts the housing along with the speaker element away from the annular frame about the hinge connection.

14. The automatic tilt speaker of claim 8, wherein the control system for processing a remote user signal to initiate the motor in either direction causes the speaker element to assume one of a number of predetermined angular positions within a tilting range of the speaker.

15. The automatic tilt speaker of claim 14, wherein the outer shell for framing the housing with speaker further includes a plurality of clamps, and an electrical terminal interface.

16. The automatic tilt speaker of claim 8, wherein the outer shell for framing the housing with speaker further includes a plurality of clamps, and an electrical terminal interface.

17. An automatic tilt speaker comprising:

a speaker;

a housing having an arcuate side surface extending from a housing bottom to a housing apex;

a seat for fixedly supporting the speaker;

a hinge for moving the speaker element along an arcuate line that coincides with the arcuate side surface about the hinge member;

a frame surrounding the housing and having a hinge base for mounting the hinge;

a tilting system including a motor driving a worm gear that tilts the housing;

a control system for processing a remote user signal to initiate the motor in either direction which causes the speaker element to assume a predetermined angular position; and an outer shell for framing the housing.

18. The automatic tilt speaker of claim 17, further comprising a seat fixedly supporting the speaker at a seat outer edge area and wherein the hinge member is located at a diametrically opposite side of the bottom of the arcuate side surface for moving the speaker along an arcuate line that coincides with the arcuate side surface about the hinge member.

19. The automatic tilt speaker of claim 17, wherein the frame surrounds the housing at the exterior of a seat of the housing and having a lateral hinge base for mounting the hinge member of the speaker to permit the speaker element in the housing to freely swivel toward and away from the frame within a certain range limited by a top interior wall of the frame abutting the exterior of the seat of the speaker housing.

20. The automatic tilt speaker of claim 17, wherein the tilting system further includes a motor mounted through a suspension bracket on a top exterior wall of the frame at a location close to the arcuate side surface of the housing, a worm gear in a driving connection through a reduction gear set to the motor and an arcuate driven gear section facing opposite to and in mesh with the driving worm gear and extending longitudinally on the arcuate surface of the housing.

21. The automatic tilt speaker of claim 17, wherein driving the motor and the worm gear in one direction gradually tilts the housing along with the speaker element away from the frame about the hinge connection.

22. The automatic tilt speaker of claim 17, wherein the control system for processing a remote user signal to initiate the motor in either direction causes the speaker element to assume one of a number of predetermined angular positions within a tilting range of the speaker.

* * * * *